United States Patent [19]

Hardy et al.

[11] Patent Number: 4,941,613

[45] Date of Patent: Jul. 17, 1990

[54] FUEL INJECTION NOZZLE

[75] Inventors: Martin P. Hardy; Paul Buckley, both of Gillingham, England

[73] Assignee: Lucas Industries public limited company, Birmingham, England

[21] Appl. No.: 335,356

[22] Filed: Apr. 10, 1989

[30] Foreign Application Priority Data

Apr. 20, 1988 [GB] United Kingdom ..... 8809268

[51] Int. Cl.[5] ..... F02M 47/00

[52] U.S. Cl. ..... 239/124; 239/533.2

[58] Field of Search ..... 239/533.2, 533.3, 533.6, 239/533.9, 533.11, 533.12, 584, 585, 124

[56] References Cited

U.S. PATENT DOCUMENTS

| | | | |
|---|---|---|---|
| 4,225,088 | 9/1980 | Kulke et al. | 239/533.9 |
| 4,285,471 | 8/1981 | Eblen et al. | 239/533.9 |
| 4,591,100 | 5/1986 | Gaskell et al. | 239/533.3 |
| 4,836,454 | 6/1989 | Gaskell | 239/533.9 |

FOREIGN PATENT DOCUMENTS

| | | | |
|---|---|---|---|
| 2555019 | 6/1977 | Fed. Rep. of Germany | 239/533.9 |

*Primary Examiner*—Andres Kashnikow
*Assistant Examiner*—Karen B. Merritt
*Attorney, Agent, or Firm*—Nixon & Vanderhye

[57] ABSTRACT

A fuel injection nozzle of the inwardly opening type has an axially movable valve member engageable under the action of a spring, with a seating to prevent fuel flow through an outlet. The valve member engaged by a spring abutment and is slidable within a sleeve and when fuel under pressure is supplied to the nozzle forces are developed on the valve member and the sleeve which is urged into contact with a part located between the sleeve and the spring abutment. A leakage path is provided to prevent a build up of fuel pressure within an annular zone defined between the part and the valve member.

9 Claims, 3 Drawing Sheets

FUEL INJECTION NOZZLE

BACKGROUND OF THE INVENTION

This invention relates to a liquid fuel injection nozzle for supplying fuel to an internal combustion engine, the nozzle being of the so-called inwardly opening type and comprising a nozzle body, a blind bore formed in the body and extending from one end thereof, a seating defined at the blind end of the bore, a fuel inlet passage communicating with the bore intermediate the ends thereof, said fuel inlet passage being connected in use to a fuel injection pump, a sleeve slidable in the end portion of the bore remote from the blind end thereof, a valve member slidable within the sleeve, the valve member being shaped for engagement with the seating to prevent fuel flow through an outlet and a spring abutment engaging with the valve member and engageable by the sleeve or a part associated therewith, the arrangement being such that when fuel under pressure is supplied through said inlet passage, the fuel pressure acting on the valve member and the sleeve will effect movement of the valve member and sleeve against the action of a spring which engages said abutment to allow fuel flow through the outlet, the nozzle also including means defining a stop surface engageable by the sleeve or said part to limit the movement of the sleeve, the further movement of the valve member away from the seating being under the action of fuel under pressure acting on the valve member alone.

Fuel injection nozzles of the aforesaid kind provide for two stages of lift of the valve member away from the seating using a single spring. The first stage of movement allows a restricted rate of fuel flow to the associated engine. The nozzle opening pressure is the pressure at which the valve member starts to lift from the seating. The checking of this pressure is required following assembly of the nozzle and it may also be required during the life of the nozzle. The nozzle opening pressure is usually checked by connecting the inlet of the nozzle to the outlet of a hand operated pump with which there is associated a pressure gauge. It is found that if the hand operated pump is operated quickly a reliable indication of the nozzle opening pressure can be obtained. However, operating the pump more slowly it is sometimes found that the pressure required to lift the valve member from the seating is higher.

An investigation of the problem has led to the discovery that when the sleeve or the aforesaid part are urged by the fuel pressure into contact with the spring abutment, an annular seal or seals is/are obtained which prevent fuel which leaks along the working clearance between the sleeve and the valve member from escaping to the usual drain. As a result a pressure build up occurs which can cause the valve member to remain in contact with the seating.

SUMMARY OF THE INVENTION

The object of the present invention is to provide a nozzle of the kind specified in a simple and convenient form.

According to the invention a fuel injection nozzle of the kind specified includes a leakage path from a zone defined within the annular area of contact between said sleeve or said part and the spring abutment.

BRIEF DESCRIPTION OF THE DRAWINGS

An example of a fuel injection nozzle in accordance with the invention will now be described with reference to the accompanying drawings in which.

DETAILED DISCUSSION OF PREFERRED EMBODIMENTS

Figure 1:
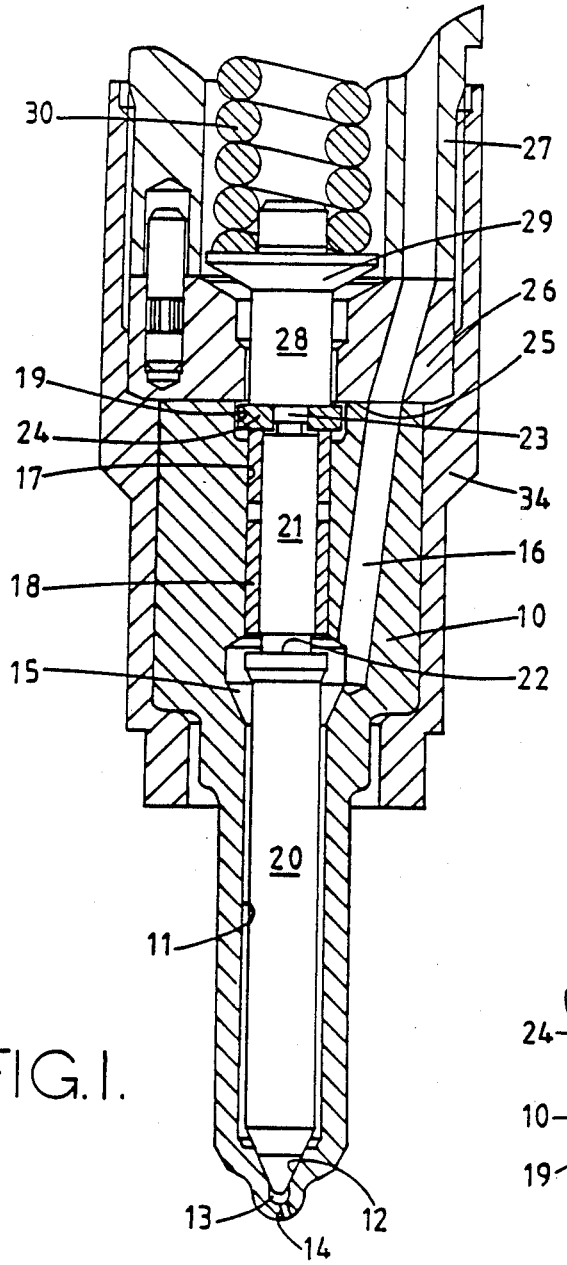
FIG. 1 is a part sectional side elevation of a portion of the nozzle.

Referring to the drawings the nozzle comprises a nozzle body 10 of stepped cylindrical form within which and extending from the wider end of the body, is a blind bore 11. At the blind end of the bore there is formed a frusto conical seating 12 which leads into a "sac" volume 13 from which extends an outlet 14. Intermediate the ends of the bore there is formed an enlargement 15 from which extends an inlet passage 16 which opens onto the wider end of the body 10. The portion 17 of the bore which lies between the enlargement and the wider end of the body is of increased diameter and within this portion of the bore there is mounted a slidable sleeve 18. In addition, the portion 17 of the bore adjacent the end of the body is enlarged to define an annular recess 19.

Extending within the bore is a valve member 20 which at its end adjacent the seating is shaped for cooperation with the seating. A clearance is established between the valve member and the main portion of the bore 11 and the valve member has a reduced portion 21 which extends within the sleeve and is slidably mounted therein. At the junction of the reduced portion of the valve member and the main portion thereof there is defined a step 22. Moreover, at the end of the valve member remote from the seating there is defined a reduced end portion 23. Surrounding the reduced end portion of the valve member and axially slidable thereon is an annular intermediate member or part 24 which is located within the recess 19.

The nozzle body in the particular example, is secured against a stop face 25 which is defined by an annular distance piece 26 which is located between the nozzle body and a hollow cylindrical nozzle holder 27. The nozzle body, the distance piece and the holder are held in assembled relationship in known manner, by means of a cap nut 34. The stop face 25 overlies the recess 19 and extending through an aperture in the distance piece 26 is a cylindrical extension 28 of a spring abutment 29. The spring abutment 29 is engaged by one end of a coiled compression spring 30 which is housed within the holder, the opposite end of the spring engaging an adjustable abutment not shown.

The distance piece 26 and the holder 27 define fuel passages which connect with the passage 16, the holder having a fuel inlet for connection in use to a fuel injection pump.

In the drawings the valve member is shown in the closed position and as more clearly seen in FIG. 2, in the closed position, the end of the reduced end portion 23 of the valve member lies slightly below the end surface of the wider end of the nozzle body. The cylindrical extension 28 of the spring abutment is in engagement with the valve member and when fuel under pressure is supplied to the inlet the fuel pressure acting on the sleeve 18 will move the sleeve upwardly into engagement with the intermediate member or part 24 which therefore will also engage with the end surface of the extension 28. It will also be noted from FIG. 2 that there is a clearance between a step 31 defined between the reduced end portion 23 and the portion 21 of the valve member, and the intermediate member or part 24.

In operation, when fuel under pressure is supplied to the enlargement 15, fuel pressure acts on the end surface of the sleeve 18 and if the sleeve is not in contact with the intermediate member and the latter in contact with the extension 28 such contact will be established. The pressure acting on the sleeve and also upon the valve member will generate forces which oppose the action of the spring 30. When the combined forces are sufficient to overcome the force exerted by the spring, the valve member and the sleeve move upwardly to allow restricted fuel flow through the outlet 14. The extent of upward movement is determined by the abutment of the intermediate member or part 24 with the stop surface 25. Further movement of the sleeve and intermediate member is therefore prevented. However, as the pressure of fuel supplied to the enlargement 15 continues to increase, a pressure will be reached at which the pressure acting on the valve member alone is sufficient to cause further movement of the valve member against the action of the spring and the valve member lifts further to allow substantially unrestricted flow of fuel through the outlet 14. The extent of further movement of the valve member is limited by the engagement of the step 31 with the intermediate member or part 24.

When the supply of fuel by the injection pump ceases, the valve member and the sleeve are returned by the action of the spring 30. The sleeve 18 may under certain conditions of operation, move downwardly further than the valve member. However, the extent of such movement is limited by its abutment with the step 22. In order to prevent distortion of the sleeve due to unequal pressures along the working clearances defined between the sleeve 18 and the portion 17 of the bore and the portion 21 of the valve member, the sleeve is provided with apertures at intervals along its length. Moreover, as will be seen from FIG. 2, the end surface of the sleeve which engages the member 24 is chamfered and in addition there is relief of the initial portion of the bore in the sleeve adjacent the chamfered end thereof.

The initial movement of the valve member is critical and this is determined by the depth of the reduced end portion 23 below the end surface of the nozzle body. This can be determined by machining the valve member to the appropriate length and the extent of further movement of the valve member is determined by the thickness of the intermediate member 24 and this can be machined to the appropriate thickness.

In the use of the nozzle there will be fuel leakage along the working clearance between the sleeve 18 and the wall of the portion 17 of the bore and along the working clearance between the valve member and the sleeve. The recess 19 does communicate with the chamber in the holder 27 which contains the spring 30 and this chamber in use is connected to a drain. The fuel which leaks along the working clearance between the valve member and sleeve cannot flow directly to the drain since when fuel under pressure applied to the sleeve and the valve member, the sleeve will move into contact with the intermediate member 24 and the latter into engagement with the extension 28 of the abutment. Since the contacting surfaces of these items are carefully ground, annular seals will be formed so that there is no escape for the fuel.

In the normal use of the nozzle the volume of fuel leaking may be very small resulting in substantially no pressure build up to influence the operation of the nozzle. However, when the nozzle is being tested and at low engine speeds, the pressure of fuel which is supplied to the nozzle inlet rises slowly and there may be a build up of fuel pressure due to the fuel leaking along the working clearance. As will be appreciated from FIG. 2 the pressure will act on the step 31 to oppose the fuel pressure acting on the lower end of the valve member and in addition the pressure will tend also to act on the end surface of the reduced portion 23 of the valve member. Moreover, pressure gradients will develop across the surfaces in sealing engagement with each other.

Figure 2:
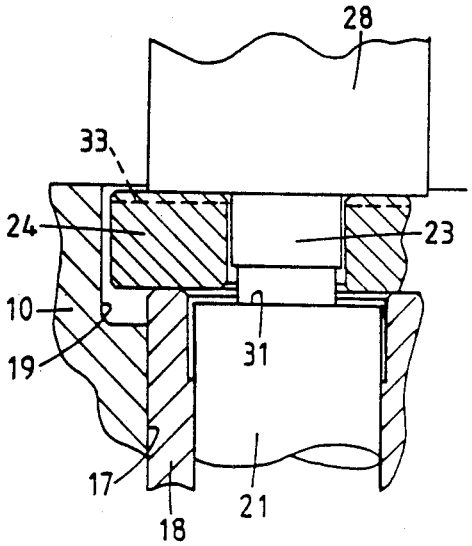
FIG. 2 is a view to an enlarged scale of part of the nozzle seen in FIG. 1.
Figure 4:
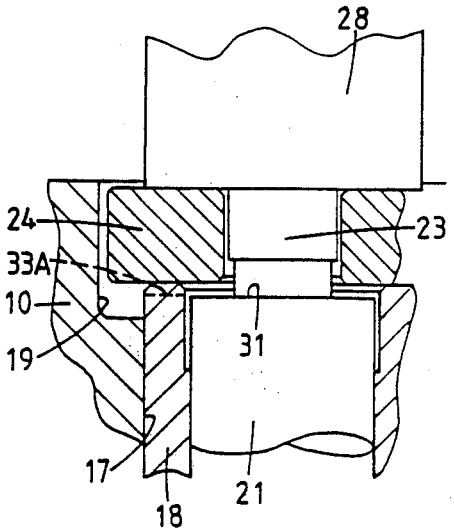
FIGS. 4 and 5 are views similar to FIG. 2 showing further modifications.
Figure 5:
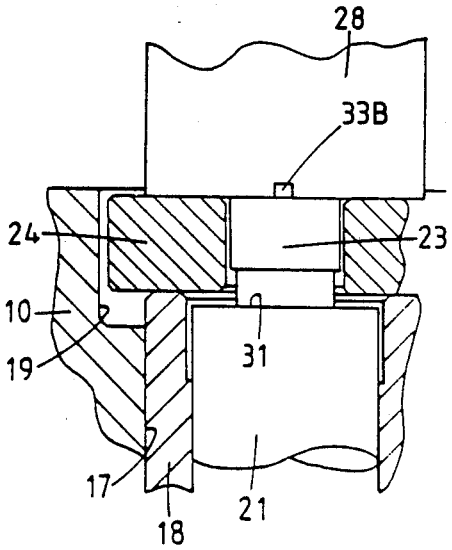

In accordance with the invention it is proposed to provide a leakage path to prevent the build up of pressure and with reference to FIG. 2, the leakage path may be formed by a slot 33 in the face of the intermediate member presented to the extension 28 or as shown in FIG. 4, by a slot 33A in the end face of the sleeve 18 presented to the intermediate member or as shown in FIG. 5, by a slot 33B formed in the end face of the extension 28.

Figure 6:
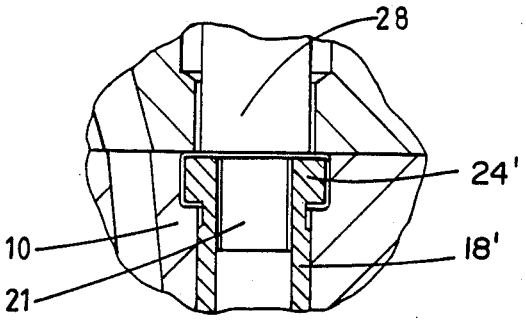
FIG. 6 is an enlarged scale of a further embodiment of the nozzle seen in FIG. 2.

Another form of injection nozzle as in FIG. 6 has the intermediate member or part formed integrally with the sleeve 18' with a flange 24'. In this case the inner wall of the sleeve is continued up to the extension 28 and an alternative method of limiting the movement of the valve member in its second stage is employed. It will be appreciated that the slots 33 and 33B can be employed with this form of nozzle to prevent the build up of pressure.

As shown the outlet orifice 14 extends from the "sac" volume 13. The invention is equally applicable to nozzles of the type in which the orifice or orifices, extends from the seating zone. Moreover, the invention may be applied to a so-called pencil injection nozzle in which the nozzle body 10 and also the valve member are of considerable length and in which the equivalent of the skirt of the cap nut is integral with the body. In this case a cup shaped closure member is screwed into the skirt to form an abutment for the spring. The fuel inlet extends laterally from the body at a position below the skirt and the stop 25 is formed on a plate which is trapped by the end closure. In this case therefore pressure exerted by the spring can be adjusted using a shim interposed between the spring and the base wall of the closure member.

Figure 3:
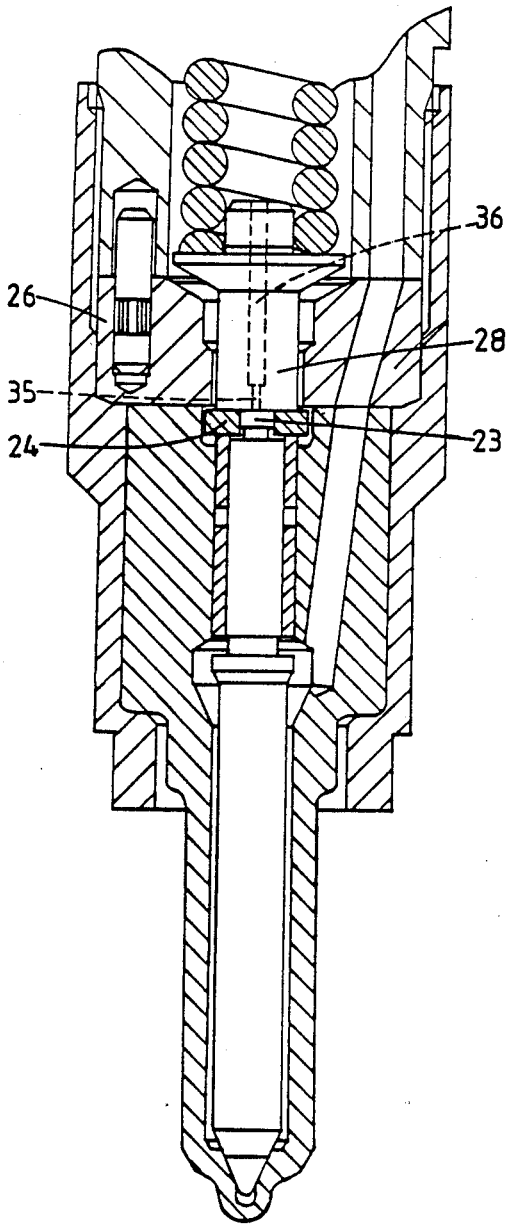
FIG. 3 is a view similar to FIG. 1 showing a modification.

FIG. 3 shows an alternative arrangement of the leakage path. In this case the extension 28 is provided with a central port 35 opening onto the end face of the reduced portion 23 of the valve member. The central port is connected by an axial passage 36 in the extension, to the chamber containing the spring. Alternatively the port may be connected to a diametrically disposed passage in the extension the opposite ends of which communicate with the space between the extension and the distance piece 26 or with an inclined passage in the extension which opens to the aforesaid space. In this arrangement in order to prevent any substantial pressure build up there must be a very slight separation of the valve member and the extension to allow leakage of fuel through the port 35. This can be overcome by arranging that the port 35 coincides with the annular gap between the intermediate member 24 and the reduced portion 23 of the valve member.

The arrangement of FIG. 3 is equally applicable to the type of nozzle in which the sleeve and intermediate member are integrally formed.

We claim:

1. A liquid fuel injection nozzle for supplying fuel to an internal combustion engine, the nozzle being of the so called inwardly opening type and comprising:

a nozzle body;

a blind bore formed in the body and extending from one end thereof;

a seating defined at the blind end of the bore;

a fuel inlet passage communicating with the bore intermediate the ends thereof;

a sleeve slidable in the end portion of the bore remote from the blind end thereof;

a valve member means, having a portion slidable in the sleeve, and shaped for engagement with the seating, for controllably preventing fuel flow through an outlet;

a spring abutment engaged with the valve member means and engageable by the sleeve;

a spring engaged with the spring abutment such that when fuel under pressure is supplied through said inlet passage, the fuel pressure acting on said valve member means and the sleeve will effect movement of the valve member means and the sleeve against the action of the spring engaging the abutment to allow fuel flow through the outlet;

means defining a stop surface engageable by an end surface of the sleeve for limiting the movement of the sleeve, the further movement of the valve member being under the action of the fuel pressure acting on the valve member alone; and means defining a leakage path extending from a zone defined within the annular area of contact between said end surface of the sleeve and the spring abutment.

2. A nozzle according to claim 1 in which said means defining a leakage path comprises a groove extending outwardly from said zone and formed in the end surface of the sleeve engageable with said spring abutment.

3. A nozzle according to claim 6 in which said means defining a leakage path comprises a groove extending outwardly from said zone and formed in the end face of said sleeve which engages said intermediate piece.

4. A nozzle according to claim 1 in which said means defining a leakage path comprises a groove which is formed in the end face of said spring abutment which is engaged by said valve member means, the groove extending outwardly from said zone.

5. A nozzle according to claim 1 in which said means defining a leakage path comprises a port in the end face of said spring abutment presented to the valve member means, said port communicating with a drain.

6. A liquid fuel injection nozzle for supplying fuel to an internal combustion engine, the nozzle being of the so-called inwardly opening type and comprising:

a nozzle body;

a blind bore formed in the body and extending from one end thereof;

a seating defined at the blind end of the bore;

a fuel inlet passage communicating with the bore intermediate the ends thereof;

a sleeve slidable in the end portion of the bore remote from the blind end thereof;

a valve member means, having a portion slidable in the sleeve and shaped for engagement with the seating, for controllably preventing fuel flow through an outlet;

a spring abutment engaged with the valve member means;

an annular intermediate piece located between the sleeve and the spring abutment;

a spring engaged with the spring abutment such that, when fuel under pressure is supplied through said inlet passage, the fuel pressure acting on said sleeve will urge the sleeve into engagement with said intermediate piece which in turn will engage the spring abutment to assist the movement of the valve member means against the action of the spring;

means defining a stop surface engageable by said intermediate piece for limiting the movement of the sleeve, the further movement of the valve member being under the action of the fuel pressure acting on the valve member alone; and means defining a leakage path from a zone defined within the annular area of contact between said intermediate piece and the spring abutment.

7. A nozzle according to claim 6 in which said means defining a leakage path comprises a groove extending outwardly from said zone and formed in the end surface of the intermediate piece engageable with the spring abutment.

8. A nozzle according to claim 6 in which said means defining a leakage path comprises a groove which is formed in the end face of said spring abutment which is engaged by said valve member means, the groove extending outwardly from said zone.

9. A nozzle according to claim 6 in which said means defining a leakage path comprises a port in the end face of said spring abutment presented to the valve member means, said port communicating with a drain.

* * * * *